US009458624B2

(12) United States Patent
Colyn

(10) Patent No.: US 9,458,624 B2
(45) Date of Patent: Oct. 4, 2016

(54) INTEGRATED SIDING RAINSCREEN AND STACKING CLIP

(71) Applicant: CertainTeed Corporation, Malvern, PA (US)

(72) Inventor: Christopher Michael Colyn, Jackson, MI (US)

(73) Assignee: CERTAINTEED CORPORATION, Malvern, PA (US)

( * ) Notice: Subject to any disclaimer, the term of this patent is extended or adjusted under 35 U.S.C. 154(b) by 0 days.

(21) Appl. No.: 14/543,101

(22) Filed: Nov. 17, 2014

(65) Prior Publication Data

US 2015/0135626 A1 May 21, 2015

Related U.S. Application Data

(60) Provisional application No. 61/905,353, filed on Nov. 18, 2013.

(51) Int. Cl.

| | |
|---|---|
| ***E04D 1/34*** | (2006.01) |
| ***E04B 1/38*** | (2006.01) |
| ***E04F 13/14*** | (2006.01) |
| ***E04F 13/08*** | (2006.01) |

(52) U.S. Cl.

CPC ..... *E04B 1/38* (2013.01); *E04F 13/0803* (2013.01); *E04F 13/0817* (2013.01); *E04F 13/148* (2013.01)

(58) Field of Classification Search

CPC .... E04B 1/38; E04F 13/148; E04F 13/0803; E04F 13/0817

USPC ..... 52/519, 520, 521, 540, 545, 547, 551, 52/553

See application file for complete search history.

(56) References Cited

U.S. PATENT DOCUMENTS

| | | | | |
|---|---|---|---|---|
| 298,143 | A | 5/1884 | Weston | |
| 2,292,984 | A | 8/1942 | Alvarez, Jr. | |
| 2,293,744 | A * | 8/1942 | Miles et al. | 52/547 |
| 2,740,166 | A * | 4/1956 | Siering | 52/553 |
| 2,928,143 | A | 3/1960 | Newton | |
| 3,173,229 | A | 3/1965 | Weber | |
| 3,325,952 | A * | 6/1967 | Trachtenberg | 52/276 |
| 3,458,962 | A * | 8/1969 | Kendall | 52/309.1 |
| 3,818,668 | A | 6/1974 | Charniga | |
| 4,485,600 | A | 12/1984 | Olson | |
| D316,299 | S | 4/1991 | Hurlburt | |
| 5,598,671 | A | 2/1997 | Ting | |
| 5,675,955 | A * | 10/1997 | Champagne | 52/521 |
| 7,441,382 | B2 * | 10/2008 | Beck et al. | 52/543 |
| D617,011 | S | 6/2010 | Guffey | |
| 7,937,902 | B1 | 5/2011 | Smith et al. | |
| 2002/0174618 | A1 * | 11/2002 | Carroll | 52/520 |
| 2004/0074188 | A1 | 4/2004 | Beck et al. | |
| 2010/0132288 | A1 | 6/2010 | Hines | |
| 2010/0146893 | A1 | 6/2010 | Dickinson | |
| 2010/0251647 | A1 | 10/2010 | Enns | |

OTHER PUBLICATIONS

Technical Search, 1 pg, 2013.

* cited by examiner

*Primary Examiner* — James Buckle, Jr.

(74) *Attorney, Agent, or Firm* — Abel Law Group, LLP; Alexander H. Plache

(57) ABSTRACT

An elongated clip for hard clapboard style siding such as fiber cement, composite wood, fiberglass, plastic, oriented strand board or other materials. The clip includes rainscreen and standoff features for proper placement from a support wall structure. In addition, the clip includes a support feature for the installation and proper alignment of an upper course of siding.

17 Claims, 5 Drawing Sheets

INTEGRATED SIDING RAINSCREEN AND STACKING CLIP

This application claims priority to and the benefit of U.S. Provisional Pat. App. No. 61/905,353, filed Nov. 18, 2013, and is incorporated herein by reference in its entirety.

BACKGROUND OF THE INVENTION

1. Field of the Disclosure

The present invention relates in general to exterior lap siding for buildings and, in particular, to a system, method and apparatus for an integrated rainscreen and stacking clip for cladding.

2. Description of the Related Art

Installing clapboard siding panels, particularly fiber cement clapboard siding panels, presents several problems. First, individual siding panels, although generally durable, are often heavy and awkward to handle, do at least in part to their density, length (up to 12-14') and bendable construction. These factors make one-person installation very difficult, if not impossible. Second, special tools, such as siding jigs, and/or precise measurements are required in order to assure that the panels have the correct amount of lap and subsequent face exposure relative to an adjacent panel.

Typically, panels are installed on a wall of a structure, generally on a sheathing product, in one of two ways—either in a so called "blind nail" method or a so called "face nail" method. In the blind nail method, illustrated in FIG. 2 of U.S. Pat. No. 7,441,382, a first siding panel 16a is aligned on the face of a wall 12 and a nail (not shown) is driven through the panel 16a, generally through an upper region of the exterior face of the panel 16a, into the wall 12. A second panel 16b is then secured to the wall 12 in the same manner using nail 18. The second panel 16b overlaps a portion of the exterior face of the first panel 16a and covers the nail or fastener driven through the first panel 16a. Another panel (not shown) is then installed overlapping panel 16b and covering nail 18. The blind nail method, although aesthetically pleasing, generally provides less wind load resistance (i.e., resistance to detachment from the wall under wind load), when compared with the face nail approach described below. With more brittle siding panels, such as fiber cement siding, smaller face exposure or face nailing is generally required for high load areas.

In the face nailing method shown by panel assembly 10 of FIG. 1 of U.S. Pat. No. 7,441,382, the first siding panel 14a is properly aligned on the wall 12. A second siding panel 14b is then aligned overlapping the first siding panel 14a, as described above, and a nail 18a is driven through both siding panels 14a, 14b, exposing the head of the nail 18a at the exterior surface of the second siding panel 14b. This process is repeated with subsequent siding courses, such as panels 14c and 14d, using nails 18b and 18c. This method provides greater wind load resistance because each panel is secured by twice as many nails when compared with the blind nail method described above, i.e., each nail is driven through two panels (e.g., panels 14a, 14b) as opposed to just one panel.

Smaller face exposure and/or face nailing are required to meet higher wind load performance requirements. These techniques, however, are undesirable for several reasons. First, the smaller face exposure and exposed nail head are both aesthetically unpleasing. Also, the corrosion resistance of the nail or fastener can diminish over time, leading to rusting and structural breach and discoloration of both the nail or fastener and the panel. Further, the top, overlapping panel, which is pierced by a nail, is exposed to the elements.

The interior of the panel can become exposed to moisture, leading potentially to delamination of the laminate clapboard structure. Still further, this exposure increases the chance of failure of the paint finish of the clapboard.

Finally, there is a growing concern in the siding industry regarding "rain screen," which drives the use of furring strips in some situations, which in turn increases the level of difficulty and cost of the installation. The furring strips act to slightly separate the rear face of the siding panels from the wall, creating a slight air gap that helps to equalize air pressure on the front, exterior and rear, interior faces of the siding panels. This helps reduce the amount of moisture that is pulled to the rear face of the siding panel, which can lead to moisture-related problems such as mold growth or wall rotting stemming from collected water or moisture. This gap, which is created by the furring strips, also provides for a rain drip or weep, which helps remove water from behind the rear face of the siding panels.

Accordingly, there is a need for a new method and apparatus for installing clapboard siding panels that allow for ease of installation and consistent lap results. Still further, there remains a need for an installation method and apparatus that provides for improved wind load resistance, rain drip and rain screen results, while preserving the life of the installed product and facilitating ease of installation.

SUMMARY

Embodiments of an integrated rainscreen and stacking clip for cladding are disclosed. In one example, a siding accessory may include a channel having an axis that defines an axial direction, and an axial length configured to receive an upper end of a course of siding. A lip may extend in the axial direction and be formed on a first end of the channel. The lip may be configured to support an upper course of siding thereon. A rainscreen can extend from the channel opposite the lip. The rainscreen may be configured to contact a support structure and separate the channel from the support structure. In addition, a plurality of weep holes may be formed in the rainscreen and may be configured to permit fluid flow therethrough.

In another embodiment, a siding product may include a siding board and a siding accessory mounted to the siding board. The siding accessory may include a channel having an axis that defines an axial direction and an axial length. The channel may receive a portion of the siding board. A lip may extend in the axial direction and be formed on a first end of the channel. The lip may be configured to support an upper course of siding board thereon. A rainscreen may extend from the channel opposite the lip. The rainscreen can be configured to contact a support structure and separate the channel from the support structure. A plurality of weep holes can be formed in the rainscreen and may be configured to permit fluid flow therethrough.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
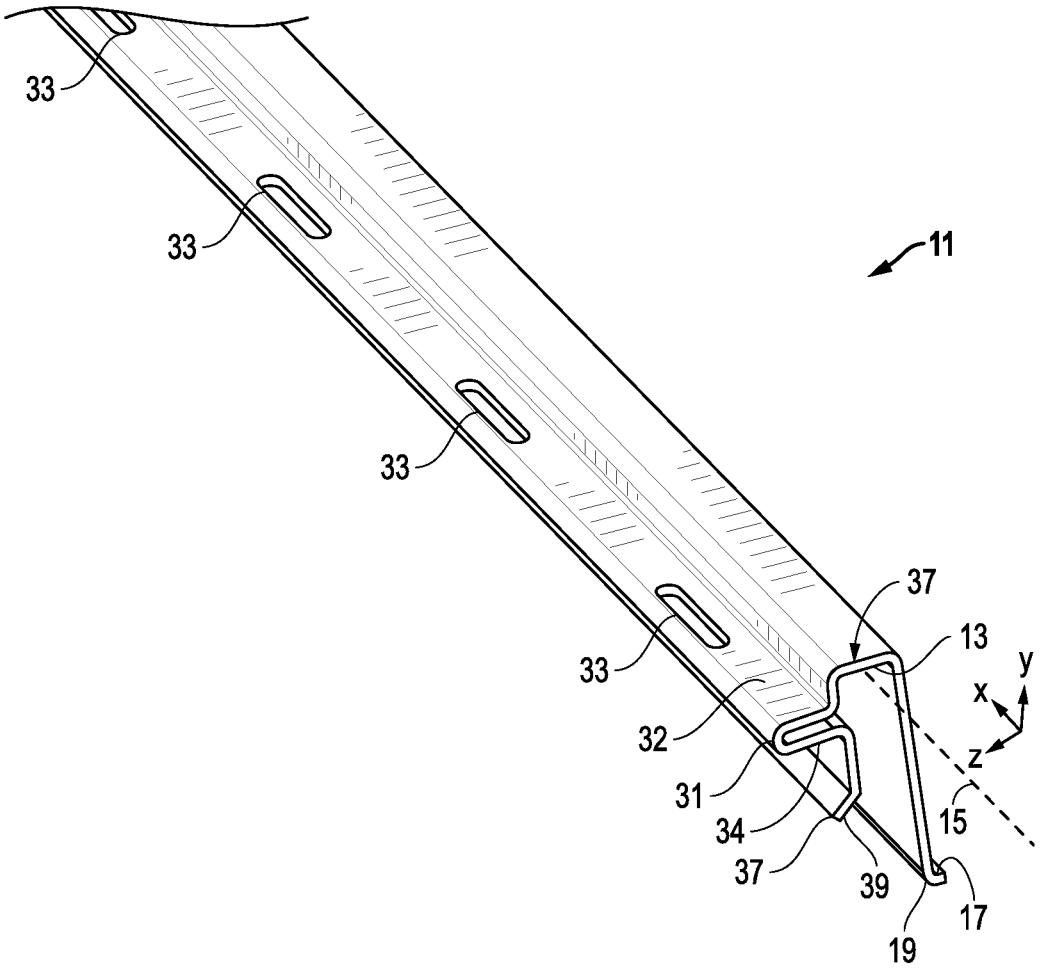
FIG. 1 is an isometric view of an embodiment of a siding accessory.

Embodiments of a system, method and apparatus for an integrated rainscreen and stacking clip for cladding are disclosed. For example, FIG. 1 depicts an embodiment of a siding accessory 11 may include a channel 13 having an axis 15 that defines an axial direction or x-direction, as indicated by the Cartesian coordinate system. The siding accessory 11 may include one or more materials, such as a polymer and/or a metal, or a composite thereof. The material of siding accessory 11 may further include a coating. The siding accessory 11 may consist exclusively of a polymer. A version of the siding accessory 11 may comprise polyvinylchloride (PVC). Another version of the siding accessory 11 does not comprise a metallic material.

Figure 2:
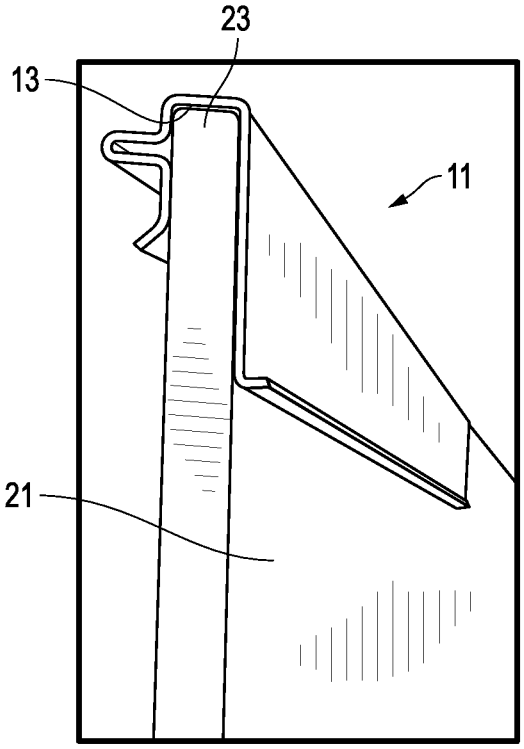
FIG. 2 is an isometric view of an embodiment of a siding accessory and siding board assembly.

The channel 13 may include an axial length configured to receive an upper end 23 (FIG. 2) of a course of siding 21. For example, the axial length can be at least about 1 foot, such as at least about 2 feet, at least about 4 feet, at least about 6 feet, at least about 8 feet, at least about 10 feet, or even at least about 12 feet. In other versions, the axial length can be not greater than about 20 feet, such as not greater than about 15 feet. The axial length can be in range between any of these values.

Figure 10:
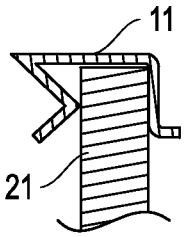
FIG. 10 is an enlarged sectional side view of another embodiment of an upper end of an assembly of a siding accessory and siding board.

Versions of the channel 13 may comprise a variety of shapes, such as a U-shape or C-shape shown in FIGS. 1-4. In other versions, the channel 13 may have still other shapes (see, e.g., FIG. 10), depending on the application.

The siding accessory 11 can include a lip 17 that extends in the axial direction. The lip 17 may be formed on a first end 19 of the channel 13. In some embodiments, the channel 13 and the lip 17 each may have an axial length of at least about 1 foot. The lip 17 can be configured to support an upper course of siding 25 (FIG. 3) thereon.

Embodiments of the siding accessory 11 may include a rainscreen 31. The rainscreen 31 can extend from the channel 13 opposite the lip 17. The rainscreen 31 may be elongated and can extend in the axial direction. In a version, the rainscreen 31 can be located between a closed end 36 of the channel 13 and the lip 17. Versions of the rainscreen 31 may be provided with an axial length that is the same or different than the axial length of the siding accessory 11, channel 13. For example, the rainscreen 31 can have an axial length of at least about 1 foot.

In an embodiment, the channel 13, lip 17 and rainscreen 31 can form a continuous and unitary structure. The rainscreen 31 may be configured to contact a support structure 27 (FIG. 4) and separate the channel 13 (and siding 21) from the support structure 27.

In some embodiments, the siding accessory 11 may include a plurality of weep holes 33. The weep holes 33 can be smaller than the rainscreen 31. The weep holes 33 may be formed in the rainscreen 31 and may be configured to permit fluid flow therethrough. In a version, each weep hole 33 can have an axial length of at least about 0.25 inches to about 2 inches. The weep holes 33 may be configured to be larger than heads of siding fasteners, such that the weep holes 33 are configured to be incapable of supporting siding fasteners.

Embodiments of the siding accessory 11 may or may not include a fastener hem. The embodiments illustrated herein do not include a fastener hem. The siding accessory 11 may or may not comprise a hole or fastener aperture 35. The fastener aperture 35 may extend through a front of the siding accessory 11 and into the channel 13. In some versions, the rainscreen 31 may be located (e.g., vertically) between the fastener aperture 35 and a top 37 of the channel 13.

Figure 3:
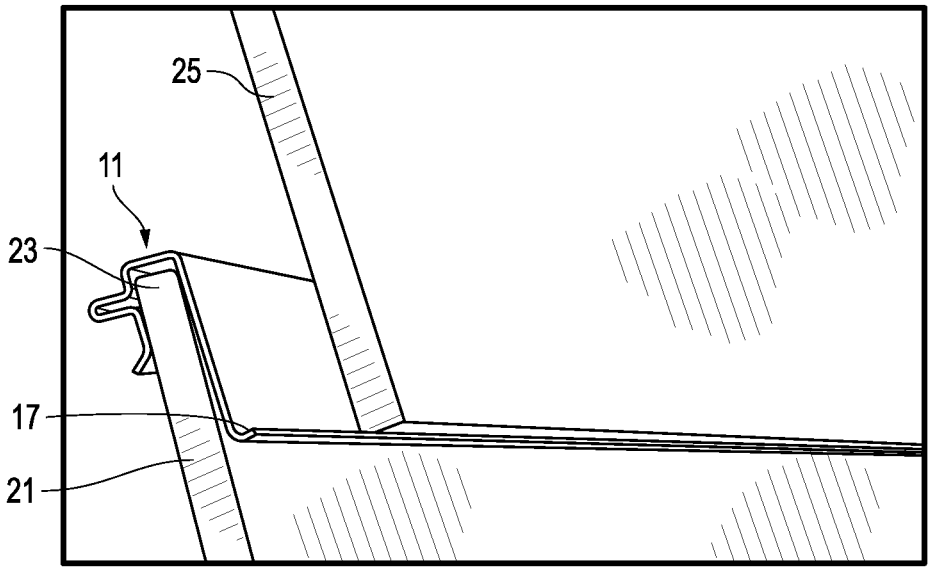
FIG. 3 is an isometric view of an embodiment of an assembly of a siding accessory and two siding boards.
Figure 4:
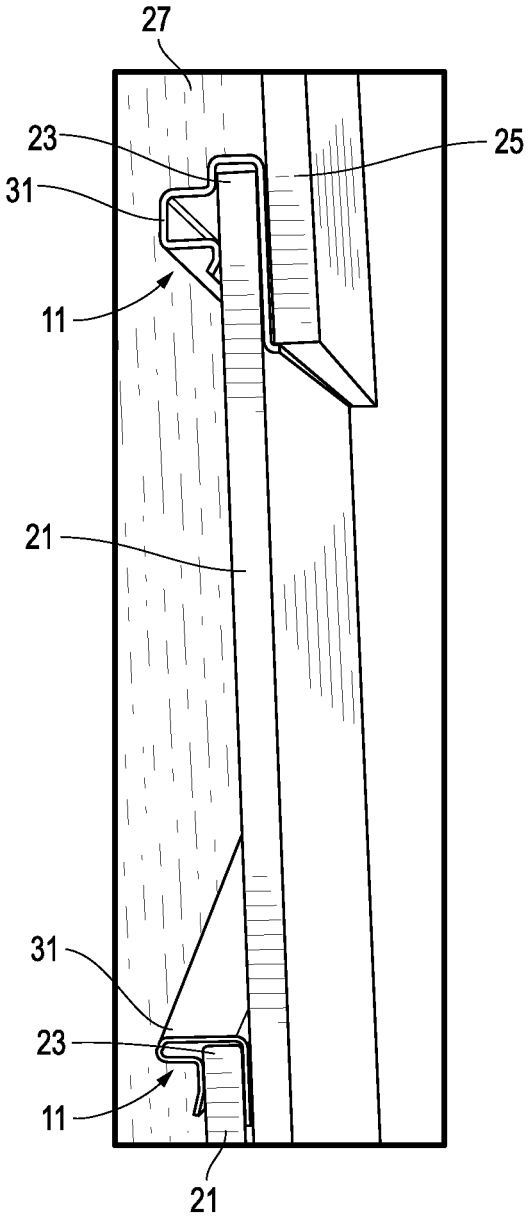
FIG. 4 is an isometric view of an embodiment of an assembly of siding accessories and siding boards.
Figure 6:
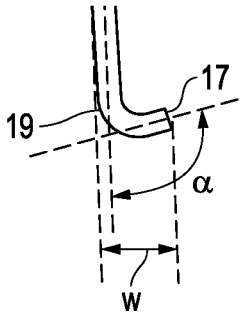

In some versions, the lip 17 can be non-planar. An embodiment of the lip 17 can extend outward from the first end 19 of the channel. For example, the lip 17 can have a curvilinear shape. See, e.g., FIG. 6. In other examples, the lip 17 can form an angle $\alpha$ with respect to a wall of the channel 13 at the first end 19 of the channel 13. For example, the angle $\alpha$ can be in a range of about 70 degrees to about 95 degrees. Embodiments of the lip 17 can be provided with an outer surface that is configured to support the upper course of siding 25 (FIGS. 3 and 4). Versions of the lip 17 may be located only on an outer surface of the upper course of siding 25, as shown, such that the lip 17 does not extend into the upper course of siding 25, but only supports it on its exterior.

In some embodiments, the channel 13 may substantially extend in a first plane of reference. Versions of the rainscreen 33 may substantially extend in a second plane of reference (e.g., the x-z plane) that is substantially perpendicular to the first plane of reference. In other embodiments, the channel 13 may substantially extend in a first plane of reference (e.g., the x-y plane), and the weep holes 33 may substantially extend in a second plane of reference (e.g., the x-z plane) that is substantially perpendicular to the first plane of reference.

Figure 5:
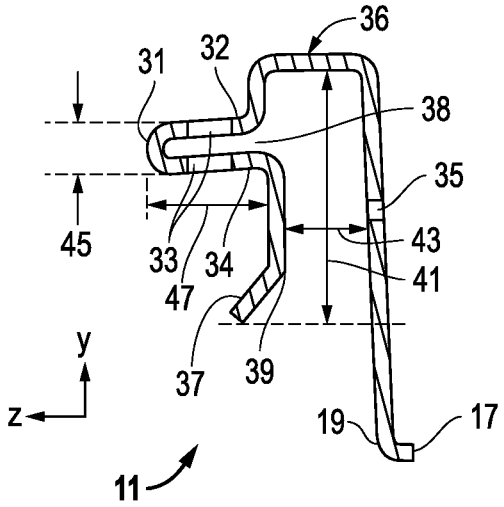
FIGS. 5-8 are sectional views of embodiments of siding accessories.

As illustrated in the drawings, the rainscreen 31 may comprise a rainscreen channel having a plurality of walls 32, 34. See, e.g., FIGS. 1 and 5. In a version, the weep holes 33 can extend through each of the plurality of walls 32, 34.

Embodiments of the siding accessory 11 and channel 13 may be provided with a second end 39. The second end 39 may include a flare 37. The flare 37 may extend in the axial direction and outward from the channel substantially opposite the lip 17. In a version, the rainscreen 31 may be located between an upper end 36 of the channel 13 and the flare 37. The flare 37 can be larger than the lip 17. In some embodiments, the channel 13 and the lip 17 each can have a continuous and uninterrupted length in the axial direction.

The channels 13 can have apertures 38 (FIG. 5) that are in fluid communication with the weep holes 33. The term "fluid communication" may be understood to mean that fluid can communicate therebetween.

In some embodiments, the axial length of the channel extends in an x-direction (FIG. 1) along axis 15. A depth 41 (FIG. 5) of the channel 13 may be defined as extending in a y-direction that is substantially perpendicular to the x-direction. A width 43 of the channel 13 may be defined as extending in a z-direction that is substantially perpendicular to the x-direction and the y-direction. In a version, the axial length (FIG. 1) of the channel 13 exceeds the depth 41. In some versions, the depth 41 exceeds the width 43.

Figure 7:
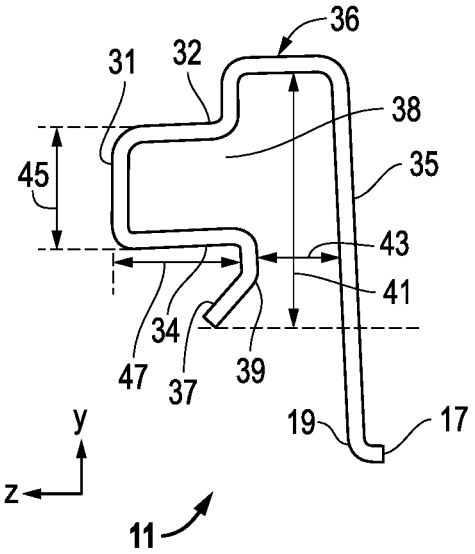

In other versions, a depth 45 of the rainscreen 31 in the y-direction is less than a width 47 of the rainscreen 31. In an embodiment, a depth 45 of the rainscreen 31 in the y-direction is less than both the depth 41 of the channel 13 and the width 43 of the channel 13. The width 47 of the rainscreen 31 in the z-direction can be substantially similar to the width 43 of the channel 13. FIG. 7 depicts another embodiment of siding accessory 11 with different dimensions.

Figure 8:
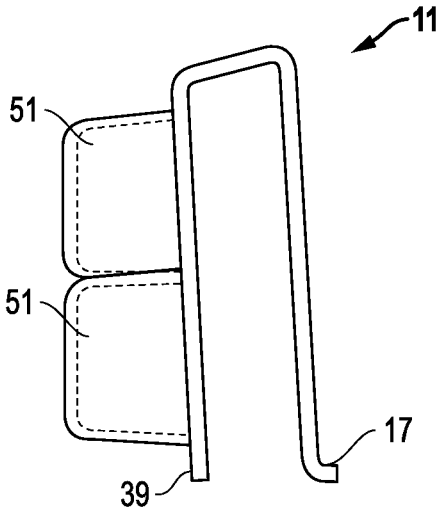
Figure 9:
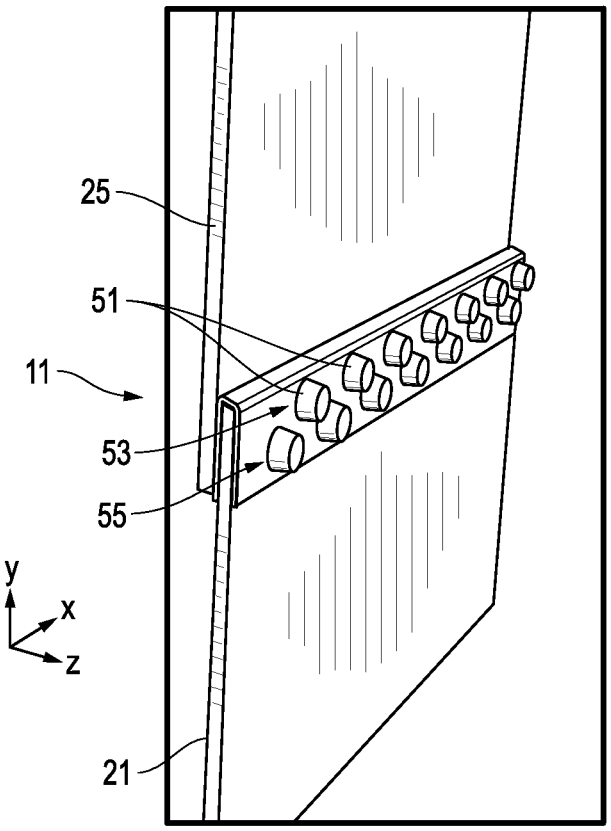
FIG. 9 is an isometric view of another embodiment of an assembly of a siding accessory and two siding boards.

In still other embodiments (see, e.g., FIGS. 8 and 9), the rainscreen may comprise a plurality of protrusions 51. The protrusions 51 may have various shapes, such as bumps, dimples, etc. The protrusions 51 may be configured in a variety of orientations. For example, the protrusions 51 may include two rows 53, 55 of alternating frustoconical dimples. A top row 53 of protrusions 51 may be located adjacent the upper end 36 of the channel 13. A lower row 55 of protrusions 51 may be located adjacent the second end 39 of the siding accessory 11. The protrusions 51 can extend from the channel 13 opposite the lip 17.

Embodiments of the channel 13 may comprise a variety of shapes. For example, the channel 13 can have a substantially rectangular axial sectional shape (FIG. 2) configured to receive the generally rectangular upper end 23 of the course of siding 21. In other versions, the channel 13 may have a radiused axial sectional shape configured to receive a generally radiused upper end of the course of siding. In still other embodiments, the channel 13 can have a first axial sectional shape and an upper end of the course of siding can have a second axial sectional shape that is not complementary to the first axial sectional shape. For example, the axial sectional shapes may include rectilinear, curvilinear, trapezoidal, symmetric and asymmetric shapes. See, e.g., FIG. 10.

Embodiments of the channel 13 may be configured to contact at least two lines or surfaces of the upper end 23 of the course of siding 21. In other embodiments, the channel 13 may be configured to contact three lines or surfaces of the upper end 23 of the course of siding 21. The channel 13 can be an uppermost portion of the siding product 11, such that all other portions of the siding product 11 may be located below the channel 13, including the lip 17, the rainscreen 31, the second end 39 and the flare 37.

In some versions, the lip 17 has a width W (FIG. 6) for supporting the upper course of siding 25 (FIG. 3). For example, the width W can be at least about 0.06 inches, such as at least about 0.09 inches, or even at least about 0.12 inches.

In still other embodiments, a siding product can include a siding board 21 and a siding accessory 11 mounted to the siding board. The siding accessory 11 may be configured as described herein. In some versions, the siding accessory 11 can be molded, embedded or extruded with the siding board 21. In another version, the siding board 21 may include at least one of wood, wood strands, wood fiber, fiber cement, oriented strand board and a composite material. In an embodiment, the siding accessory 11 can extend from the siding board 21 and may have at least a portion located inside an interior of the siding board 21. In other embodiments, the siding accessory 11 can be mounted only to an exterior of the siding board 21. The siding accessory 11 can be bonded to the exterior of the siding board 21. In another version, the channel 13 can have a first axial sectional shape and an upper end 23 of the course of siding 21 can have has a second axial sectional shape that is either complementary to or not complementary to the first axial sectional shape.

Some embodiments may include one or more of the following items:

Item 1. A siding accessory, comprising:

a channel having an axis that defines an axial direction, and an axial length configured to receive an upper end of a course of siding;

a lip extending in the axial direction and formed on a first end of the channel, and the lip is configured to support an upper course of siding thereon;

a rainscreen extending from the channel opposite the lip, and the rainscreen is configured to contact a support structure and separate the channel from the support structure; and a plurality of weep holes formed in the rainscreen and configured to permit fluid flow therethrough.

Item 2. The siding accessory of item 1, wherein the channel has a U-shape or C-shape.

Item 3. The siding accessory of item 1, wherein the siding accessory does not have a fastener hem.

Item 4. The siding accessory of item 1, wherein further comprising a fastener aperture formed in the channel.

Item 5. The siding accessory of item 1, wherein the channel does not have a fastener aperture formed therein.

Item 6. The siding accessory of item 1, wherein the lip is non-planar, or wherein the lip is curvilinear.

Item 7. The siding accessory of item 1, wherein the lip forms an angle with respect to a wall of the channel at the first end of the channel, and the angle is in a range of about 70 degrees to about 95 degrees.

Item 8. The siding accessory of item 1, wherein the lip has an outer surface that is configured to support the upper course of siding, and the lip is located only on an outer surface of the upper source of siding, such that the lip does not extend into the upper course of siding.

Item 9. The siding accessory of item 1, wherein the axial length is at least about 1 foot, at least about 2 feet, at least about 4 feet, at least about 6 feet, at least about 8 feet, at least about 10 feet, or at least about 12 feet, and the axial length is not greater than about 20 feet, or not greater than about 15 feet.

Item 10. The siding accessory of item 1, wherein the channel and the lip each have an axial length of at least about 1 foot.

Item 11. The siding accessory of item 1, wherein the rainscreen has an axial length of at least about 1 foot, and the weep holes are smaller than the rainscreen.

Item 12. The siding accessory of item 1, wherein the siding accessory comprises a polymer, wherein the siding accessory consists exclusively of a polymer, wherein the siding accessory comprises polyvinylchloride (PVC).

Item 13. The siding accessory of item 1, wherein the siding accessory does not comprise a metallic material.

Item 14. The siding accessory of item 1, wherein each weep hole has an axial length of at least about 0.25 inches to about 2 inches.

Item 15. The siding accessory of item 1, wherein the rainscreen is located between a closed end of the channel and the lip.

Item 16. The siding accessory of item 1, wherein the weep holes in the rainscreen are configured to be larger than heads of siding fasteners, such that the weep holes are configured to be incapable of supporting siding fasteners.

Item 17. The siding accessory of item 1, wherein the channel substantially extends in a first plane of reference, and the rainscreen substantially extends in a second plane of reference that is substantially perpendicular to the first plane of reference.

Item 18. The siding accessory of item 1, wherein the channel substantially extends in a first plane of reference, and the weep holes substantially extend in a second plane of reference that is substantially perpendicular to the first plane of reference.

Item 19. The siding accessory of item 1, wherein the rainscreen comprises a rainscreen channel having a plurality of walls, and the weep holes extend through each of the plurality of walls.

Item 20. The siding accessory of item 1, wherein the lip extends outward from the first end of the channel, and the channel has a second end with a flare that extends in the axial direction and outward from the channel substantially opposite the lip.

Item 21. The siding accessory of item 20, wherein the rainscreen is located between an upper end of the channel and the flare.

Item 22. The siding accessory of item 20, wherein the flare is larger than the lip.

Item 23. The siding accessory of item 1, wherein the channel and the lip each have a continuous and uninterrupted length in the axial direction.

Item 24. The siding accessory of item 1, wherein the channels have apertures that are in fluid communication with the weep holes.

Item 25. The siding accessory of item 1, wherein the axial length extends in an x-direction, a depth of the channel extends in a y-direction that is substantially perpendicular to the x-direction, and a width of the channel extends in a z-direction that is substantially perpendicular to the x-direction and the y-direction, and the axial length exceeds the depth.

Item 26. The siding accessory of item 25, wherein depth exceeds the width.

Item 27. The siding accessory of item 25, wherein a depth of the rainscreen in the y-direction is less than a width of the rainscreen.

Item 28. The siding accessory of item 25, wherein a depth of the rainscreen in the y-direction is less than both the depth of the channel and the width of the channel.

Item 29. The siding accessory of item 25, wherein a width of the rainscreen in the z-direction is substantially similar to the width of the channel.

Item 30. The siding accessory of item 1, wherein the rainscreen is elongated and extends in the axial direction.

Item 31. The siding accessory of item 1, wherein the rainscreen comprises a plurality of protrusions.

Item 32. The siding accessory of item 31, wherein the plurality of protrusions extend from the channel opposite the lip.

Item 33. The siding accessory of item 1, wherein the channel, lip and rainscreen form a continuous and unitary structure.

Item 34. The siding accessory of item 1, wherein the channel has a substantially rectangular axial sectional shape configured to receive a generally rectangular upper end of the course of siding.

Item 35. The siding accessory of item 1, wherein the channel has a radiused axial sectional shape configured to receive a generally radiused upper end of the course of siding.

Item 36. The siding accessory of item 1, wherein the channel has a first axial sectional shape and an upper end of the course of siding has a second axial sectional shape that is not complementary to the first axial sectional shape.

Item 37. The siding accessory of item 1, wherein the channel is configured to contact at least two lines or surfaces of the upper end of the course of siding.

Item 38. The siding accessory of item 1, wherein the channel is an uppermost portion of the siding product, such that all other portions of the siding product are located below the channel.

Item 39. The siding accessory of item 1, wherein the lip has a width for supporting the upper course of siding, and the width is at least about 0.06 inches, at least about 0.09 inches, or at least about 0.12 inches.

Item 40. The siding accessory of item 4, wherein the rainscreen is located between the fastener aperture and a top of the channel.

Item 41. A siding product, comprising:

a siding board; and a siding accessory mounted to the siding board; the siding accessory comprising:

a channel having an axis that defines an axial direction and an axial length, the channel receiving a portion of the siding board;

a lip extending in the axial direction and formed on a first end of the channel, the lip being configured to support an upper course of siding board thereon;

a rainscreen extending from the channel opposite the lip, the rainscreen being configured to contact a support structure and separate the channel from the support structure; and a plurality of weep holes formed in the rainscreen and configured to permit fluid flow therethrough.

Item 42. The siding product of item 41, wherein the siding accessory is molded, embedded or extruded with the siding.

Item 43. The siding product of item 41, wherein the siding board comprises at least one of wood, wood strands, wood fiber, fiber cement, oriented strand board and a composite material.

Item 44. The siding product of item 41, wherein the siding accessory extends from the siding board and has at least a portion located inside an interior of the siding board.

Item 45. The siding product of item 41, wherein the siding accessory is mounted only to an exterior of the siding board.

Item 46. The siding accessory of item 45, wherein the siding accessory is bonded to the exterior of the siding board.

Item 47. The siding product of item 41, wherein the channel has a first axial sectional shape and an upper end of the course of siding has a second axial sectional shape that is either complementary to or not complementary to the first axial sectional shape.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A siding accessory, comprising:

a channel having an axis that defines an axial direction, and an axial length configured to receive an upper end of a course of siding;

a lip extending in the axial direction and formed on a first end of the channel, and the lip is configured to support an upper course of siding thereon;

a rainscreen extending from the channel opposite the lip, the rainscreen is configured to contact a support structure and separate the channel from the support structure, and the rainscreen comprises walls; and a plurality of weep holes extending through at least one of the walls of the rainscreen and configured to permit fluid flow therethrough.

2. The siding accessory of claim 1, wherein the siding accessory does not have a fastener hem, and the axial length is at least about 1 foot and not greater than about 15 feet.

3. The siding accessory of claim 1, wherein the lip has an outer surface that is configured to support the upper course of siding, and the lip is located only on an outer surface of the upper source of siding, such that the lip does not extend into the upper course of siding.

4. The siding accessory of claim 1, wherein the siding accessory comprises a polymer and does not comprise a metallic material.

5. The siding accessory of claim 1, wherein the rainscreen is located between a closed end of the channel and the lip.

6. The siding accessory of claim 1, wherein the weep holes are configured to be larger than heads of siding fasteners, such that the weep holes are configured to be incapable of supporting siding fasteners.

7. The siding accessory of claim 1, wherein the channel substantially extends in a first plane of reference, and the rainscreen substantially extends in a second plane of reference that is substantially perpendicular to the first plane of reference.

8. The siding accessory of claim 1, wherein the lip extends outward from the first end of the channel, and the channel has a second end with a flare that extends in the axial direction and outward from the channel substantially opposite the lip.

9. The siding accessory of claim 1, wherein the channel has an aperture that is in fluid communication with the weep holes.

10. The siding accessory of claim 1, wherein the channel has a first axial sectional shape and an upper end of the course of siding has a second axial sectional shape that is not complementary to the first axial sectional shape.

11. The siding accessory of claim 1, wherein the channel is configured to contact at least two lines or surfaces of the upper end of the course of siding, and the channel is an uppermost portion of the siding product, such that all other portions of the siding accessory are located below the channel.

12. A siding accessory, comprising:

a channel having an axis that defines an axial direction, a first end, a second end opposite the first end, an axial length configured to receive an upper end of a course of siding, and the axial length is at least about 1 foot and not greater than about 15 feet;

a lip extending in the axial direction and formed on the first end of the channel, and the lip is configured to support an upper course of siding thereon;

a rainscreen extending from the channel adjacent the second end, and the rainscreen is configured to contact a support structure and separate the channel from the support structure; and weep holes formed in the siding accessory and configured to permit fluid flow therethrough.

13. The siding accessory of claim 12, wherein the rainscreen is located between a closed end of the channel and the second end of the channel, and the weep holes are formed in and extend through the rainscreen.

14. The siding accessory of claim 12, wherein the weep holes are configured to be larger than heads of siding fasteners, such that the weep holes are configured to be incapable of supporting siding fasteners.

15. The siding accessory of claim 12, wherein the channel substantially extends in a first plane of reference, and the rainscreen substantially extends in a second plane of reference that is substantially perpendicular to the first plane of reference.

16. The siding accessory of claim 12, wherein the lip extends outward from the first end of the channel, and the second end has a flare that extends in the axial direction and outward from the channel substantially opposite the lip.

17. The siding accessory of claim 12, wherein the channel has an aperture extending into the rainscreen, and the aperture is in fluid communication with the weep holes.

* * * * *